US005485934A

United States Patent [19]

Holztrager

[11] Patent Number: 5,485,934

[45] Date of Patent: Jan. 23, 1996

[54] MERCHANDISE DISPLAY ASSEMBLY

[75] Inventor: William J. Holztrager, Chilhowie, Va.

[73] Assignee: Display Systems, Inc., Chilhowie, Va.

[21] Appl. No.: 76,049

[22] Filed: Jun. 16, 1993

[51] Int. Cl.[6] ..... A47B 43/00

[52] U.S. Cl. ..... 211/194; 211/13; 211/162

[58] Field of Search ..... 211/194, 188, 211/94.5, 162, 189, 94, 133, 129, 144, 13; D6/396, 397

[56] References Cited

U.S. PATENT DOCUMENTS

| | | | |
|---|---|---|---|
| 2,246,448 | 6/1941 | Mahan, Jr. | 211/188 X |
| 3,655,065 | 4/1972 | Yellin | 211/194 |
| 4,377,231 | 3/1983 | Murphy | 211/194 X |
| 4,527,697 | 7/1985 | Mastrodicasa | 211/189 |
| 4,592,601 | 6/1986 | Hlinsky et al. | 211/194 X |
| 4,936,472 | 6/1990 | Meier | 211/194 |
| 5,147,120 | 9/1992 | Ray | 211/194 X |
| 5,191,983 | 3/1993 | Hardy | 211/194 |
| 5,192,042 | 3/1993 | Wotring | 211/194 X |

FOREIGN PATENT DOCUMENTS

| | | | |
|---|---|---|---|
| 340433 | of 1959 | Switzerland | 211/194 |

*Primary Examiner*—Alvin C. Chin-Shue
*Assistant Examiner*—Korie H. Chan
*Attorney, Agent, or Firm*—Shlesinger Arkwright & Garvey

[57] ABSTRACT

A merchandise display assembly comprising a plurality of modular sections adapted to be assembled stacked relationship. The assembly is of tubular design and each section has a plurality of elongated side members, the lateral ends of which are secured together. The upper and lower edges of the side members are provided with portions for interfitting the modular section with subjacent and superjacent modular sections when the sections are stacked. Ribs extend outwardly from the outer surfaces of the side members to which merchandise display cards or holders may be attached for displaying the merchandise. The ribs may differ in number, size and spacing to accommodate different types of merchandise display cards and holders.

18 Claims, 3 Drawing Sheets

FIG. 1
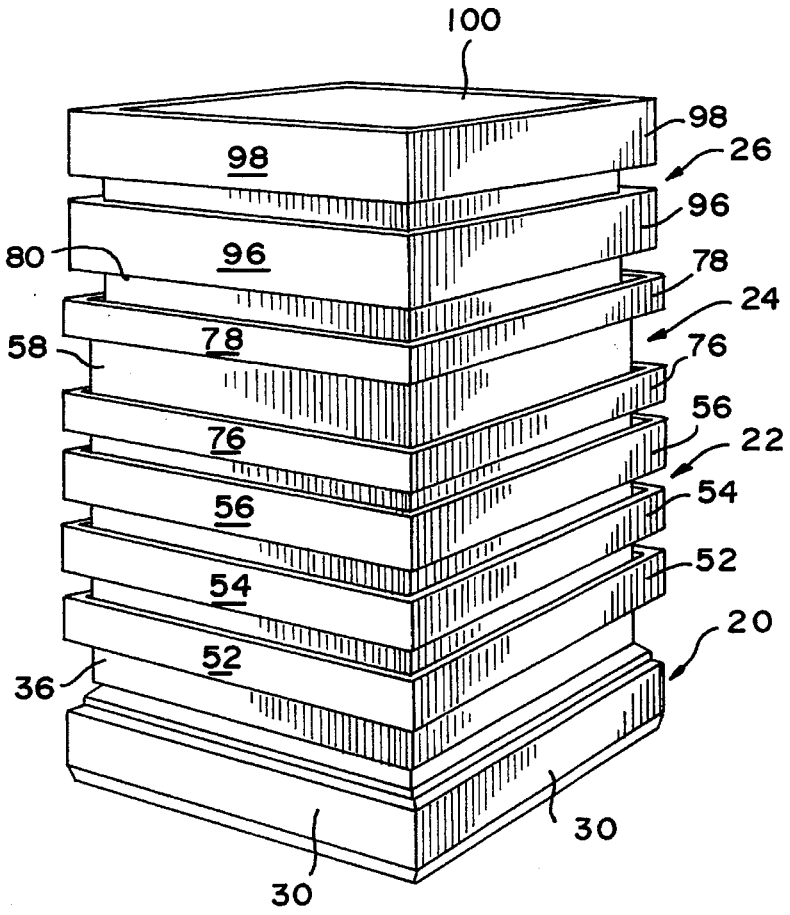
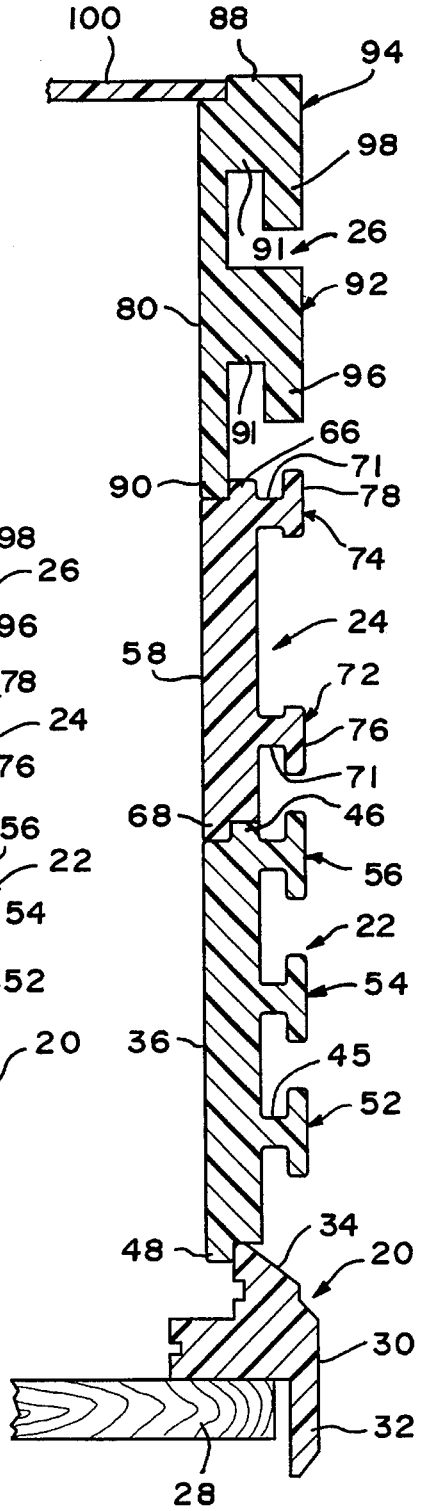
FIG. 2

MERCHANDISE DISPLAY ASSEMBLY

FIELD OF THE INVENTION

This invention is a merchandise display assembly.

BACKGROUND OF THE INVENTION

It is conventional practice to display items of merchandise such as jewelry and other small items by mounting the items on display cards or other merchandise holders, and then displaying these items on point of purchase display stands located in stores, which stands may either be floor mounted or counter mounted. These stands may be stationary, or rotatable, and are usually of parallelepiped or other tubular construction, to provide a plurality of surfaces on which the merchandise may be displayed for sale.

Up to the present time, it has been necessary to provide display stands of different heights and different outer surface profiles to accommodate different types of cards, hooks, etc. on which the items are mounted. This requires the manufacturer to carry an inventory of display stands of different heights, and different outer surface profiles in order to accommodate the needs of the merchandiser.

SUMMARY OF THE INVENTION

This invention is a merchandise display assembly of modular construction comprising a plurality of sections of closed geometrical configuration which are assembled together in stacked relationship, the number of sections determining the height of the assembly. The outer surface profile of each section may be the same or different to permit display of different types of merchandise as desired.

Each section of the assembly is preferably of polygonal design in cross-section, and comprises a plurality of elongated side members of the same height, and of extruded plastic construction, the ends of which members are mitered for fitting engagement with adjacent side members.

The outer surface of each side member is provided with spaced, longitudinally extending rib portions, which provide a profile for attaching the items of merchandise to the assembly.

The top and bottom edges of each side member are provided with coextensive longitudinal, complemental flange and groove portions to permit interfitting engagement of subjacent and superjacent side members of sections which are in stacked relationship therewith. Adhesive means hold the stack sections in fixed relation to each other.

By providing a display assembly constructed of a plurality of modular sections, the outer surface profile rib portions of the sections may be varied in size, location and spaced relationship in order to accommodate different types of display members, thereby offering the merchandiser a single display assembly which may be assembled in a manner to display either the same or a wide variety of merchandise items.

DESCRIPTION OF THE FIGURES OF THE DRAWING

FIG. 1 is a perspective view of the merchandise display assembly of the present invention;

FIG. 2 is an enlarged vertical sectional view of the merchandise display assembly illustrated in FIG. 1;

DETAILED DESCRIPTION OF THE INVENTION

Figure 7:
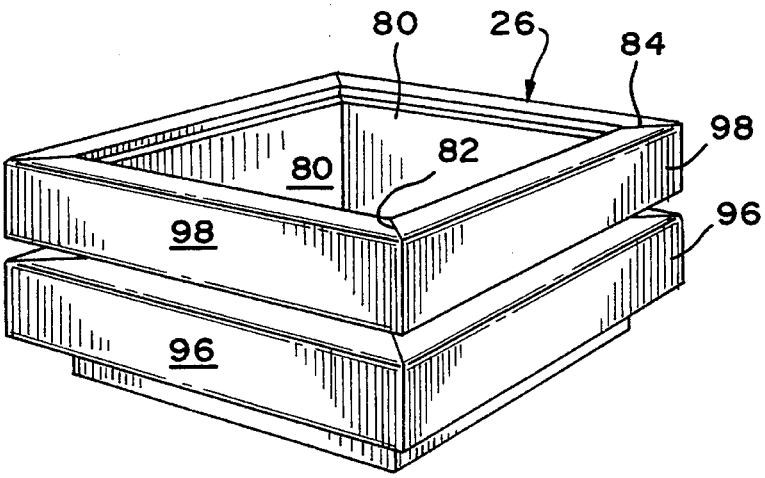
FIG. 7 is a perspective view of a third modular section forming a part of the merchandise assembly illustrated in FIG. 1.

The merchandise display assembly of the present invention is preferably of closed geometric conformation comprising a plurality of tubular sections having rectilinear or curvilinear wall members which are preferably of extruded plastic construction of polyvinylchloride or other suitable material.

In the preferred form of the present invention, illustrated in the drawings, the assembly is of parallelepiped design and includes a base section 20, a first modular section 22, a second modular section 24 and a third modular section 26, which sections and base are adapted to be selectively assembled together in stacked relationship.

Base 20 includes a generally square body member 28 which is in supporting engagement with four like side members 30 of elongated, rectangular shape, the ends of which are mitered and secured together to form the four sides of the base member. A portion of the side member 30 extends downwardly to form a flange or skirt portion 32. Another portion of generally triangular shape extends upwardly as indicated at 34 to provide supporting engagement for modular section 22, as shown to advantage in FIG. 2.

Each of modular sections 22, 24, and 26 are of basically similar construction and size, in order to permit assembly of the sections together in stacked relationship.

Figure 3:
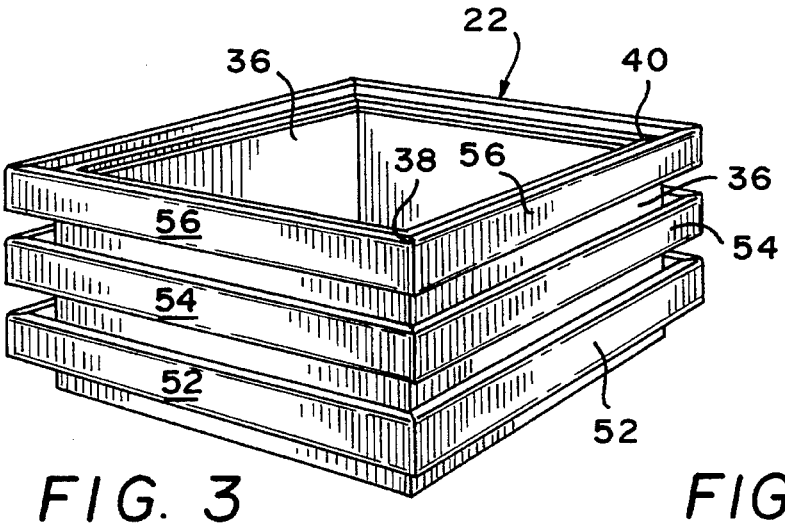
FIG. 3 is a perspective view of the modular section forming a part of the merchandise display assembly illustrated in FIG. 1.
Figure 4:
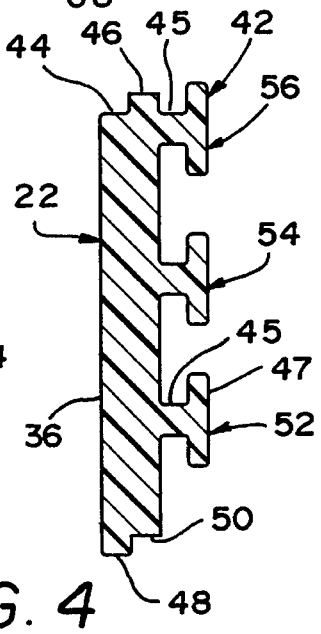
FIG. 4 is an enlarged vertical sectional view of the modular section illustrated in FIG. 3.
Figure 9:
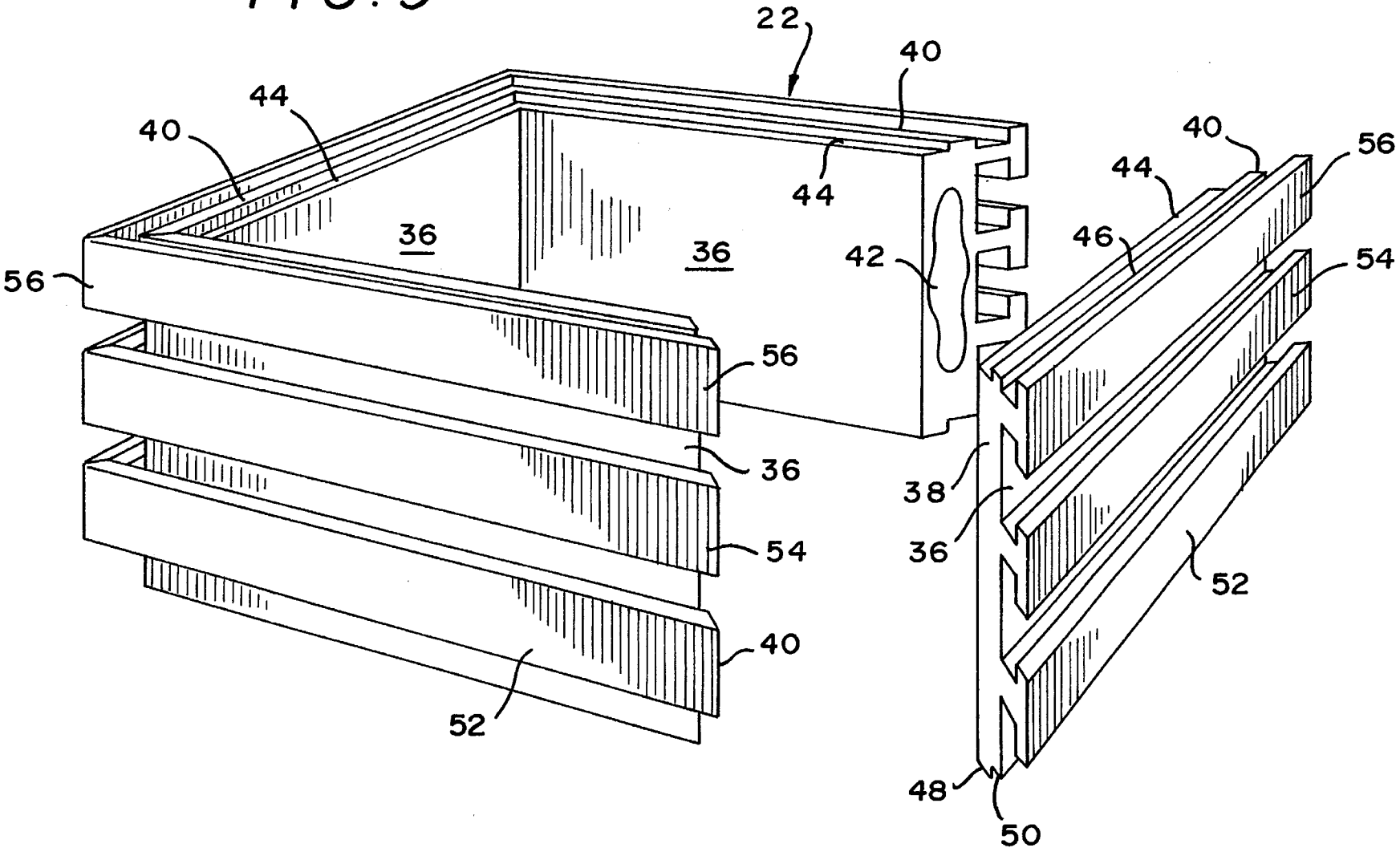
FIG. 9 is an enlarged perspective view of the modular section illustrated in FIG. 5, showing one side thereof removed to disclose details of construction.

Modular section 22 is shown to advantage to FIG. 3, 4 and 9, and includes four like side members 36 of elongated construction, the lateral ends of which are mitered as indicated at 38 and 40. The mitered ends of each side member are engaged with each other and securely held by means of adhesive 42 or other suitable means. The upper edge of each side member 36 is provided with an inner groove 44 and an outer flange 46 which are coextensive with the length of the side member.

The lower edge of each side member 36 is provided with a complemental inner flange member 48 and an outer longitudinal groove 50 which are coextensive with side member 36, for interfitting engagement of section 42 with a subjacent base 20 and a superjacent section 24, as illustrated in FIG. 2.

In accordance with the principal objects of the present invention, the outer surface of each side member 36 is provided with a plurality of outwardly extending, spaced ribs 45 and flange members 47 of generally T-shaped cross-section, as illustrated at 52, 54 and 56 which are coextensive with the length of each side member, and in which lie in parallel, predetermined spaced relationship with each other to provide a profile for holding merchandise display cards, acrylic holders, and other types of support members on which merchandise may be displayed.

Figure 5:
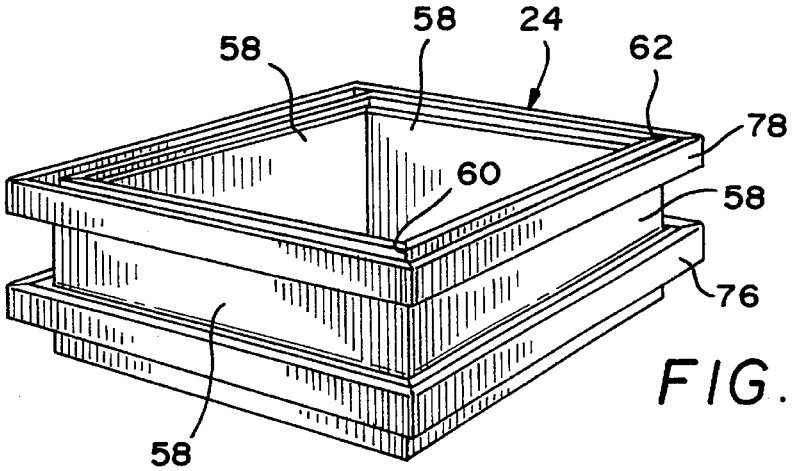
FIG. 5 is a perspective view of a second modular section forming a part of the merchandise display assembly of FIG. 1.
Figure 6:
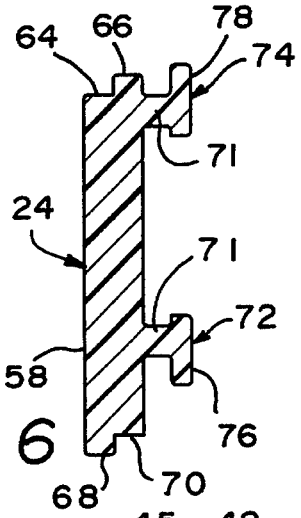
FIG. 6 is an enlarged vertical sectional view of the modular section illustrated in FIG. 5.

As shown to advantage in FIGS. 5 and 6, modular section 24 is of the same basic construction as modular section 22, including four side members 58 of elongated rectilinear shape, the lateral ends of which are mitered at 60 and 62, and the upper edges of which are provided with an inner longitudinal groove 64 and an outer flange 66 which are coextensive with the length of the side member. The lower edge of each side member 58 is provided with an inner flange member 68 and an outer longitudinal groove 70, which are coextensive with the length of side member 58.

The outer surface of each side member 58 is provided with outwardly extending, parallel spaced ribs 71 and flange members 72 and 74. The outer end of flange member 72 terminates in a downwardly extending flange 76, and the outer extremity of flange 74 terminates in an upwardly extending flange 78.

Figure 8:
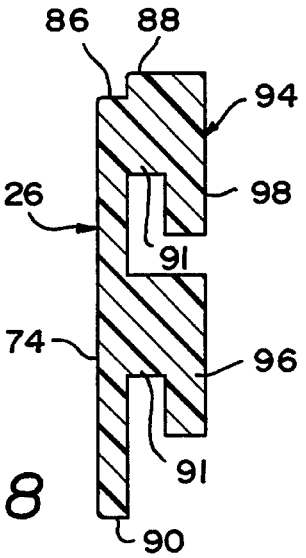
FIG. 8 is an enlarged vertical sectional view of the modular section illustrated in FIG. 7.

As shown to advantage in FIGS. 7 and 8, modular section 26 includes four elongated side members 80, of elongated rectangular shape, the lateral ends of which are mitered as indicated at 82 and 84. The upper edge of each side member 80 is provided with an inner longitudinal groove 86 and a longitudinal flange 88 which are coextensive with the length of the side member. The lower edge of each side member 80 is provided with an inner flange 90 which is coextensive with the length of side member 26. The outer surface of each side member 80 is provided with spaced outwardly extending parallel ribs 91 and flange members 92 and 94 which terminate in downwardly extending flanges 96 and 98.

As will be apparent from a comparison of FIGS. 3 to 8, the outer profiles of modular sections 22, 24 and 26 are substantially different in height, shape and spacing from each other in order to accommodate different types of merchandise display supports, thereby making it possible to display a wide variety of merchandise on a single merchandise display assembly.

In accordance with the present invention, the same or different modular sections such as shown in FIGS. 3, 5 and 7 are selectively assembled in any combination or arrangement depending upon the merchandise to be displayed. The lower section, such as section 22 is placed on base 20, and may be secured thereto by adhesive or any other suitable means. The different modular sections are then placed one on top of the other in stacked relationship as indicated in the drawings by interfitting the adjacent grooves and flanges of the modular sections in engagement with each other, and applying adhesive or other suitable securing means to maintain the sections in fixed relationships with each other. A lid 100 may be positioned on the top upper modular section to present a finished appearance to the assembly.

Although there has been herein shown and described a display assembly embodying three modular sections, it is to be understood that additional modular sections having the same or different outer surface profiles may be employed, and the particular sections to be used are determined by the merchandise which is to be displayed thereon.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as may be applied to the central features hereinbefore set forth, and fall within the scope of the invention and of the limits of the appended claims.

What I claim is:

1. A merchandise display assembly, comprising:

a) a plurality of modular sections adapted to be assembled in stacked relationship;

b) each of said modular sections including a plurality of side members;

c) each of said members comprising a body portion having outer and inner surfaces, lateral edge portions and top and bottom edges;

d) said lateral edge portions of each side member being joined together to another side member to form a closed section of geometrical configuration;

e) said top and bottom edges of one said side member being adapted for interfitting with said top and bottom edges of another side member to form the stacked relationship of said modular sections;

f) a plurality of ribs extending outwardly from the outer surface of said modular sections in spaced relationship to each other;

g) a plurality of spaced parallel flange members secured respectively to said ribs, each of said flange members extending vertically; and h) said ribs and flange members being adapted for securing a merchandise for display.

2. The merchandise display assembly as in claim 1, and further comprising:

a) a base section comprising side members for supporting engagement with the lowest of the stacked modular sections.

3. The merchandise display assembly as in claim 1, wherein:

a) said ribs are substantially coextensive with respective said side members.

4. The merchandise display assembly as in claim 1, and further comprising:

a) adhesive for securing said modular sections in the stacked relationship.

5. The merchandise display assembly as in claim 1, wherein:

a) each of said top edges includes an inner longitudinal groove and an outer longitudinal flange that are coextensive with the top edge of each of said side members;

b) each of said bottom edges includes an inner longitudinal flange and an outer longitudinal groove that are coextensive with the bottom edge of each of said side members; and c) said top and bottom grooves and longitudinal flanges of said side members are adapted to interfit with said top and bottom grooves and longitudinal flanges of sub-adjacent and super-adjacent modular sections.

6. The merchandise display assembly as in claim 1, and further comprising:

a) adhesive for securing said lateral edges together.

7. A merchandise display as in claim 1, wherein:

a) said closed section of geometrical configuration is polygonal.

8. A merchandise display as in claim 1, wherein:

a) said closed section of geometrical configuration is tubular.

9. A merchandise display as in claim 1, wherein:

a) said side members are made of extruded plastic.

10. A merchandise display as in claim 1, wherein:

a) said lateral edges are mitered.

11. A merchandise display as in claim 1, wherein:

a) said side members, ribs and flange members are extruded from plastic in one piece.

12. A merchandise display as in claim 1, wherein:

a) the number, size and spacing of said flanges are selectively varied to permit attachment of different types of merchandise items thereto.

13. A merchandise display as in claim 1, wherein:

a) the size of, and the distance between, said ribs of one modular section being different from the other modular section to permit attachment of different types of merchandise items thereto.

14. A merchandise display assembly, comprising:

a) a modular section adapted to be assembled in stacked relationship with another modular section;

b) said modular section including a plurality of side members;

c) each of said members comprising a body portion having outer and inner surfaces, lateral edge portions and top and bottom edges;

d) said lateral edge portions of each side member being joined together to another side member to form a closed section of geometrical configuration;

e) said top and bottom edges of one said side member being adapted for interfitting with the corresponding top and bottom edges of the side member of another modular section to form the stacked relationship;

f) a plurality of ribs extending outwardly from the outer surface of said modular section in spaced relationship to each other;

g) a plurality of spaced parallel flange members secured respectively to said ribs, each of said flange members extending vertically; and h) said ribs and flange members being adapted for securing a merchandise for display.

15. The merchandise display assembly as in claim 14, wherein:

a) each of said top edges includes an inner longitudinal groove and an outer longitudinal flange;

b) each of said bottom edges includes an inner longitudinal flange and an outer longitudinal groove; and c) said top and bottom grooves and longitudinal flanges of said side members are adapted to interfit with the corresponding top and bottom grooves and longitudinal flanges of sub-adjacent and super-adjacent modular sections.

16. The merchandise display assembly as in claim 14, wherein:

a) said lateral edges are mitered.

17. The merchandise display assembly as in claim 14, and further comprising:

a) adhesive for securing said lateral edges together.

18. A merchandise display as in claim 14, wherein:

a) said side members, ribs and flange members are extruded from plastic in one piece.

* * * * *